US005533448A

United States Patent [19]

Klingler

[11] Patent Number: 5,533,448

[45] Date of Patent: Jul. 9, 1996

[54] DEVICE FOR CONTROLLING THE SHEET INLET WHEN STARTING UP A SHEET-PROCESSING PRINTING MACHINE

[75] Inventor: Horst Klingler, Mülheim, Germany

[73] Assignee: MAN Roland Druckmaschinen AG, Germany

[21] Appl. No.: 315,118

[22] Filed: Sep. 29, 1994

[30] Foreign Application Priority Data

Sep. 29, 1993 [DE] Germany ..... 43 33 071.1

[51] Int. Cl.[6] ..... B41F 15/02; B41F 31/15

[52] U.S. Cl. ..... 101/233; 101/DIG. 32

[58] Field of Search ..... 101/144, 145, 101/142, 351, 352, DIG. 32, 349, 207–210, 232, 233, 234

[56] References Cited

U.S. PATENT DOCUMENTS

| | | |
|---|---|---|
| 3,056,346 | 12/1962 | Gammeter et al. . |
| 3,818,827 | 6/1974 | Johne et al. . |
| 5,096,183 | 3/1992 | Hauck et al. . |
| 5,186,105 | 2/1993 | Emrich et al. . |

FOREIGN PATENT DOCUMENTS

| | | |
|---|---|---|
| 1155146 | 10/1963 | Germany . |
| 89115 | 4/1972 | Germany . |
| 3044643A1 | 9/1981 | Germany . |
| 212475B1 | 8/1984 | Germany . |
| 4001120A1 | 7/1991 | Germany . |
| 4112222A1 | 10/1992 | Germany . |
| 2071064 | 9/1981 | United Kingdom . |

*Primary Examiner*—J. Reed Fisher
*Attorney, Agent, or Firm*—Leydig, Voit & Mayer, Ltd.

[57] ABSTRACT

A method and a device for controlling the sheet inlet when starting up a sheet-processing printing machine having a vibrator-type inking unit, in which the sheets are positioned at front lays, their correct position is established and, in the case of the position having been established as correct, the sheet inlet is cleared at a particular machine position. The intention is to avoid the first entering sheet running into the printing machine in each case at different phases of the vibrator cycle in the case of a plurality of start-up operations. This is achieved according to the invention in that the first sheet is conveyed up to the positioning line, the feeder is then switched off and the sheet inlet is only cleared again when the vibrator gearing assumes a particular angular position.

7 Claims, 2 Drawing Sheets

DEVICE FOR CONTROLLING THE SHEET INLET WHEN STARTING UP A SHEET-PROCESSING PRINTING MACHINE

FIELD OF THE INVENTION

The invention relates to a control system for a printing machine, and more particularly, to the control of the sheet inlet when starting up the printing machine.

BACKGROUND OF THE INVENTION

In sheet-fed offset printing machines, the sheets are stacked individually in a feeder and are removed by means of suction devices which are in phase with the printing machine. The sheets are then transported via a conveying table in a continuous shingled or fish scale stream to the positioning lays of a feed table. Alignment of the sheets takes place at the positioning lays in the sheet-conveying direction as well, as transversely thereto. At the same time, the position of the sheet is determined by sensory scanners, for example photoelectric sensors, which sense the leading edge of the sheet. As long as the sheets are positioned correctly, they are picked up by a pregripper and transferred to a first sheet-conveying cylinder.

Control devices for correct sheet running in the region of the positioning lays of sheet-fed offset printing machines are known, for example, from U.S. Pat. Nos. 5,096,183 (corresponding to German Pat. No. DE 4 001 120 A1) and 5,186,105 (corresponding to German Pat. No. DE 4 112 222 A1), and from U.K. Pat. No. GB 2 071 064 A (corresponding to German Pat. No. DE 3 044 643 A1). In these published devices, the control systems monitor the sheet feeding with the positioning lays during operation of the printing machine. More particularly, the sheet position is interrogated at the positioning line in one or more angular positions of a single-revolution shaft of the machine. However, these control devices do not address the problems associated with starting up the printing machine (i.e. the printing machine has no sheets present on the feeder table and a first sheet is conveyed to the-positioning lays (front lays) by switching on the feeder).

It is generally known that just after starting up, but also after a stoppage, a relatively large amount of waste paper is produced. This is due to two problems. The first problem concerns time constraints related to the vibrator-type inking unit of a sheet-fed offset printing machine. The inking unit has a relatively great inertia and requires time to build up a stable ink distribution. Until the stable ink distribution is maintained, the printing machine cannot properly process sheets. For example, in the case of very high vibrator cycles, the printing machine must carry out a multiplicity of revolutions before the vibrator transports ink from the ink duct roller to the first distributor roller.

The second problem is caused by the misalignment of the rollers with the inking unit. In virtually all sheet-fed offset printing machines, the vibrator is driven geared down (i.e. a movement of the vibrator between the duct roller, the first inking unit roller (distributor) and back to the ink duct roller takes place in more than one machine revolution). Vibrator cycles of 3:1 or 6:1 are usual, whereby one vibrator movement takes place in each case to 3 or 6 machines revolutions, respectively (single-axis shaft). In the case of a very low application of ink, however, it may also be necessary to set a vibrator cycle of 72:1.

In the case of multiple stoppages or production interruptions, the conditions for the re-inlet of a first sheet with respect to the rollers are arbitrary. It then depends on the skill of the printer by appropriate counter-control to reduce the amount of waste paper. However, depending on when the sheet inlet is cleared in relation to the position of the vibrator gearing, a compensation once carried out successfully may cause even more waste paper in a subsequent restart operation. This applies, in particular, to an automatic ink regulating algorithm for the purpose of avoiding start-up waste paper.

SUMMARY OF THE INVENTION

It is a general object of the invention to develop a method and a control system which reduce the amount of waste paper generated by a printing machine upon startup of operations.

It is a related object of the invention to provide a method and a control system which monitor a printing machine so that a stable ink distribution is built up before the printing machine processes the first sheet.

It is a further related object of the invention to provide a method and a control system which can monitor a printing machine so that the vibrator roller is in synchronous position with the inking unit rollers before the printing machine processes the first sheet.

The present invention accomplishes these objectives and overcomes the drawbacks of the prior art by providing for a control system for a printing machine which more effectively monitors the flow of sheets to the printing machine upon startup of operations. To control the flow of sheets upon startup, the printing machine is operated in an ordinary manner until the first sheet triggers a sensor at the front lays of the feeder table. The control system then effectively stops the motion of the sheet by turning off the feeder table and the sheet grippers at the front lays.

The control system then continues running the printing machine so that the inking unit may build up a stable ink distribution. Further, the control system runs the machine in a pre-startup mode until the printing machine is in a predetermined angular position of the vibrator gearing. The predetermined angular position depends on the geometry and the design of the drive of the pregripper, the vibrator gearing, and the gearing mechanisms of the printing-unit cylinders. The angular position may be determined by printing trials and manually input into the control system.

Sensors, which determine the angular position of the gears, indicate to the control system when the printing machine is in the proper gearing position to process the first sheet. Upon proper position, the control system resumes the normal operation of the printing machine by reactivating the feeder table and the pregrippers. The first sheet, which is at the front lays, is then processed through the printing machine with enough ink in the rollers and with the rollers in proper alignment.

These and other features and advantages of the invention will be more readily apparent upon reading the following description of the preferred embodiment of the invention and upon reference to the accompanying drawings wherein:

DESCRIPTION OF A PREFERRED EMBODIMENT

Figure 1:
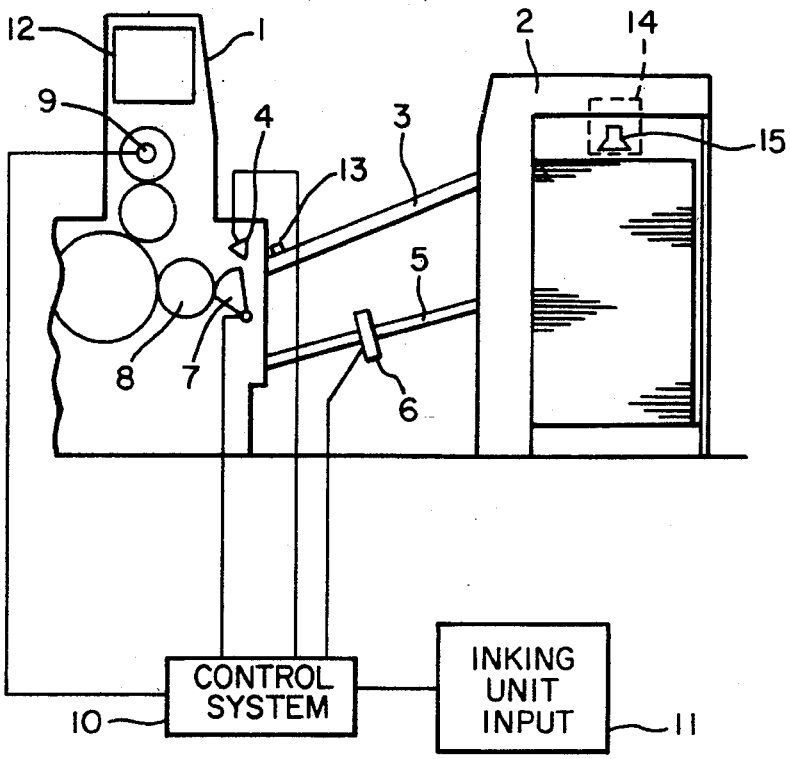
FIG. 1 is a side view of a sheet fed offset printing machine with a feeder.

FIG. 1 shows diagrammatically the printing unit of a sheet-fed offset printing machine 1 with a feeder 2 and a feeder table 3.

By using suction heads 15 contained within a suction head unit 14, the sheets are removed from the feeder 2 and are conveyed via the feeder table 3 to the front lays 13. Monitoring of the correct contact of the sheets takes place at the front lays 13 by means of one or more scanners 4. In this case, the transporting devices of the feeder 2 and the conveying means of the feeder table 3 are driven by the drive of the sheet-fed offset printing machine 1. This is done with a drive shaft 5 which is connected to an electrically switchable coupling 6 between the sheet-fed offset printing machine 1 and the feeder 2.

In the normal operation of the printing machine, sheets, which are conveyed correctly against the front lays 13 of the feeder table 3, are picked up by a pregripper 7 and transferred to the first sheet-conveying cylinder 8. In the startup operation of the printing machine, there are no sheets on the feeder table 3 so that the first sheet must be conveyed from the sheet pile in the feeder 2.

According to the invention, conveying of sheets via the feeder table 3 takes place during a startup operation until the correct position of a first sheet against the front lays 13 is established by the scanners 4. The feeder drive is then switched off by actuating the coupling 6. Further, the pregripper 7 is blocked, so that the grippers do not pick up the correctly positioned sheet. The printing machine 1 is then effectively decoupled from the sheet feeder 3. The drive of the sheet-fed offset printing machine 1 still remains switched on to initialize the printing machine properly.

The sheet-fed offset printing machine 1 has an angular-position transmitter 9 which is mounted on a single-axis shaft. The shaft can be, for example, the axle of the plate cylinder or the drive shaft of the cam drive of the pregripper 7.

Figure 3:
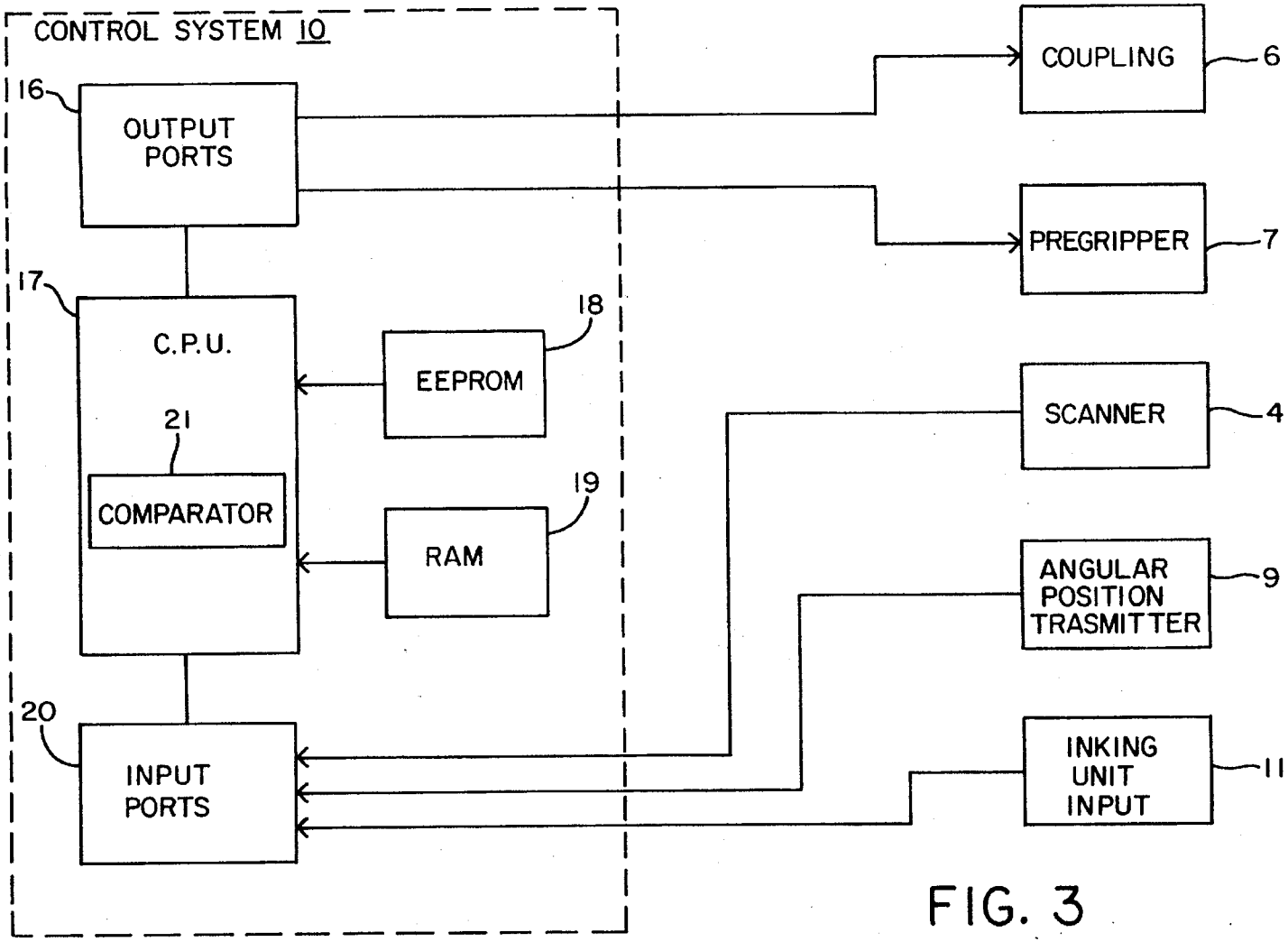
FIG. 3 is a block diagram of the control system.

As shown in FIG. 3, the control system 10 is designed as a computer receiving input to the input ports 20 from the inking unit input 11, the angular-position transmitter 9, and the scanner 4. The control system 10 sends outputs to the output ports 16 to the coupling 6 to decouple the feeder 2 and to the pregripper 7 to block and unblock the pregripper 7.

The inking unit input 11 feeds the information regarding the vibrator gearing of the first printing unit to the control system 10. The information in the inking unit input 11 may be manually input by an operator. Based on this input, the control system 10 can determine the corresponding vibrator cycle of the sheet-fed offset printing machine 1. As best illustrated in FIG. 3, the control system 10 receives the information from inking unit input 11 at a central processing unit (CPU) 17. The CPU 17 polls the EEPROM 18 to determine the vibrator cycle for the current operation of the printing machine 1.

Based on the vibrator cycle of the current operation of the printing machine 1, the control system 10 determines the corresponding angular position of the cylinders for correct operation of the printing machine 1. The CPU 17 of the control system 10 polls the EEPROM 18 for the angular position value. The actual angular orientation of the cylinders is input via an angular-position transmitter 9. The angular-position transmitter 9 transmits data not only in relation to one revolution but over a multiplicity of revolutions.

After a first sheet is positioned correctly at the front lays 13, the scanner 4 sends a signal to the control system 10 via the input ports 20. The control system 10 then sends the signal to the CPU 17 which sends a signal via the output ports 16 to decouple the coupling 6, thereby switching off the feeder 2. The control system 10 then compares the present angle of the angular-position transmitter 9 with the correspondingly predetermined desired value based on the inking unit input 11. This comparison is done within the CPU 17 by the comparator 21. When the sheet-fed offset printing machine 1 has carried out a particular number of revolutions, so that the vibrator inking unit 12 has assumed a particular working position, as determined by the CPU 17, the control system 10 sends signals via the output ports 16. The feeder 2 is then reactivated by actuating the coupling 6 and the pregripper 7 is unblocked. The first sheet is then picked up by the pregripper 7 and transferred to the first sheet-conveying cylinder. The feeder is also reactivated, sending sheets to the printing machine 1.

The angular position, which signifies that the initialization of the printing machine 1 is complete, depends on the geometry and design of the drive of the pregripper 7 of the vibrator gearing and of the gearing mechanisms bringing about the engagement and disengagement of the printing-unit cylinders. Through the control system 10, the actuation of the coupling 6 of the feeder 2, and the blocking/unblocking of the pregripper 7, the sheets do not enter the printing machine 1 in a random manner. This is true even when the vibrator cycles are high (large gearing down of the cam disc of the vibrator).

Figure 2:
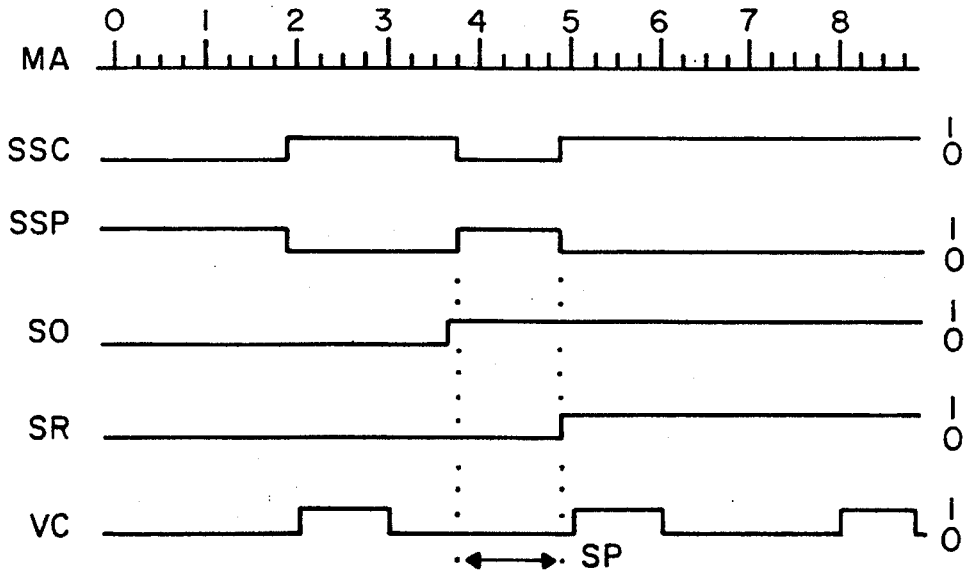
FIG. 2 is a timing diagram of the inputs and outputs of the control system.

FIG. 2, in the form of a timing diagram, again illustrates the synchronization, according to the invention, of the sheet inlet with the vibrator cycle. In the first line of this chart, the so-called machine angle MA is plotted. The numbers across the top of the timing diagram represent the angles of machine rotation which the printing machine has carried out.

In the first line below the machine angle MA, the switching state of the coupling 6 of the feeder 2 in FIG. 1 is illustrated as waveform SSC. This switching state alternatively assumes the specified states 1 (on—coupling is actuating to activate feeder) and 0 (off— coupling disengaged to deactivate feeder). In the line located below it, the switching state of the pregripper 7 is illustrated as waveform SSP. This assumes the switching states 1 (locked—pregripper unable to pick up sheet) or 0 (free—pregripper picks up sheet). The waveform SO represents the timing of the output of the scanner 4, which determines when a sheet is positioned at the front lays 13. The output of the scanner can assume the signal states 0 (no sheet) or 1 (sheet positioned correctly).

The waveform SR signifies the timing of the sheets running into the machine. In this case, the state is specified by levels 0 (no sheet in the machine) or 1 (sheet in machine). The last waveform VC signifies the timing of the switching of the vibrator cycle, whereby the vibrator is switched off at level 0 and switched on at level 1.

In the example of FIG. 2, it is assumed that the drive of the printing machine is switched on at time 0 (i.e., MA is at zero revolutions). Shortly before the second revolution, the coupling 6 of the feeder 2 is engaged as signified by the timing waveform SSC, so that the feeder 2 now conveys sheets onto the feeder table 3. At the same time, the pregripper 7 is switched from the blocked state 1 into the free state 0 as signified by the waveform SSP, so that the grippers will now pick up a positioned sheet. Shortly before the fourth revolution the signal from the scanner 4 shows that a sheet is positioned correctly at the front lays. The timing waveform SO changes from 0 to 1, causing the coupling 6 of the feeder 2 to be disengaged by the control system 10, whereupon the pregripper is also blocked again (state 1). In the example of FIG. 2, the vibrator cycle is 3:1 so that for every three revolutions there is one vibrator cycle. Therefore, the vibrator cycle switches on between the second and third revolutions, between the fifth and sixth revolutions, and then again between the eighth and ninth revolutions of the printing machine.

After a sheet is correctly position at the front lays 13 and the coupling 6 and the pregripper 7 have been released or blocked (line SSC or SSP), the re-engagement of the coupling 6 of the feeder 2 and the clearing of the blocking of the pregripper 7 (SSC, SSP) only take place after almost more than one revolution. That is to say, in this exemplary embodiment, a sheet would always run into the machine only shortly before the switching possibility of the vibrator. By means of the synchronizing pause SP, as shown in line VC, the sheet is thus prevented from entering one or two revolutions prior to this state.

Instead of an angular-position transmitter 9, a sensor can also be mounted directly on the vibrator drive, which sensor records, for example, the position of the pawl which brings about the engagement or disengagement of the vibrator (cam drive with roller lever and pawl whereby the sensor is on the pawl).

What is claimed is:

1. A controller for controlling startup operations of a printing machine and a sheet feeder unit, the printing machine having a vibrating-type inking unit, at least one single-axis shaft and a pregripper, and the sheet feeder unit having a drive and position lays which feed sheets to the pregripper, the controller comprising: a sheet sensor for determining when a sheet is at the position lays; an angular sensor for determining the angular position of the single-axis shaft; an inking unit input for determining the operating mode of the vibrating-type inking unit; a control system responsive to the sheet sensor for holding the sheet at the position lays; the control system including memory containing the proper angle of the single-axis shaft based on the operating mode of the vibrating-type inking unit, means for operating the printing machine until the vibrating-type inking unit generates a stable ink distribution, a comparator for operating the printing machine until the proper angle equals the angular position of the single-axis shaft; and means for releasing the sheet at the position lays.

2. A controller as defined in claim 1 wherein the sheet sensor is a photoelectric sensor.

3. A controller as defined in claim 1 wherein the angular sensor is an angular-position transmitter.

4. A controller as defined in claim 1 wherein the inking unit input is a manual input from an operator.

5. A controller as defined in claim 1 wherein the drive of the feeder is coupled to the printing machine by a coupler.

6. A controller as defined in claim 5 wherein the controller holds the sheets at the positioning lays by decoupling the coupler to the feeder and by deactivating the pregripper.

7. A controller as defined in claim 5 wherein the means for releasing the sheet at the position lays includes activating the coupler of the feeder and activating the pregripper.

* * * * *